United States Patent [19]

Macholdt et al.

[11] Patent Number: 4,777,105

[45] Date of Patent: Oct. 11, 1988

[54] MAGENTA COLORANT FOR ELECTROPHOTOGRAPHIC RECORDING PROCESSES

[75] Inventors: Hans-Tobias Macholdt, Darmstadt; Alexander Sieber, Frankfurt am Main; Adolf Kroh, Selters, all of Fed. Rep. of Germany

[73] Assignee: Hoechst Aktiengesellschaft, Frankfurt am Main, Fed. Rep. of Germany

[21] Appl. No.: 55,347

[22] Filed: May 28, 1987

[30] Foreign Application Priority Data

May 30, 1986 [DE] Fed. Rep. of Germany ..... 3618214

[51] Int. Cl.[4] ..... G03G 9/08; G03G 9/10

[52] U.S. Cl. ..... 430/109; 430/110

[58] Field of Search .....430/106.6, 109, 110, 430/111

[56] References Cited

U.S. PATENT DOCUMENTS 3,160,510 12/1964 Ehrich .
3,804,619 4/1974 Mammino et al. .
3,909,259 9/1975 Mammino et al. .
4,057,426 11/1977 Mammino et al. .
4,698,289 10/1987 Aldrich et al. ..... 430/106.6

FOREIGN PATENT DOCUMENTS 1217333 5/1966 Fed. Rep. of Germany .
896916 5/1962 United Kingdom .

*Primary Examiner*—John L. Goodrow

[57] ABSTRACT

An improved magenta colorant for electrophotographic multicolor recording processes, comprising mix-crystals from 95 to 60 parts of a compound of the formula I below and 5 to 40 parts of a compound of the following formula II

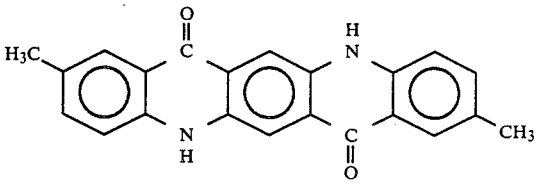

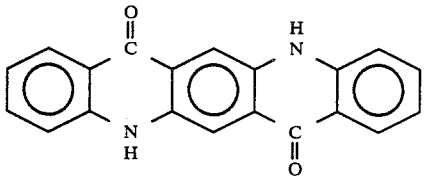

and use thereof for preparing toners or developers which are used for electrophotographic copying of subject copies and for printing electronically, optically and magnetically stored data.

3 Claims, No Drawings

MAGENTA COLORANT FOR ELECTROPHOTOGRAPHIC RECORDING PROCESSES

The present invention relates to an improved magenta colorant for electrophotogrphic multicolor recording processes which comprises a mix-crystal from 2,9-dimethylquinacridone and unsubstituted quinacridone in a certain mixing ratio.

On the basis of the principle of subtractive color mixing it is possible to reproduce the entire spectrum of colors visible to the human eye by means of the three primary colors yellow, cyan and magenta. Exact reproduction of color is only possible if the particular primary color meets the precisely defined coloristic requirements. Otherwise, some colors cannot be reproduced and the color contrast is not sufficient.

In electrophotographic recording processes, not only must the toner have the correct shade (the toner being the colorant-containing component which does the coloring in the recording process) but the toner must also be triboelectrically chargeable, the sign and the level of chargeability being of fundamental importance.

The present invention has for its object to find a magenta colorant which improves the triboelectric chargeability of the toner and at the same time has the required shade and transparency.

In electrophotographic recording processes, a latent charge image is produced for example on a photoconductor drum. This is done by charging the photoconductor drum with a corona discharge and then subjecting the electrostatically charged surface of the photoconductor drum to image-wise exposure, which causes the charge to flow to the earthed base in the exposed areas. Then the latent charge image thus produced is developed by applying a toner.

In a subsequent step, the toner is transferred from the photoconductor drum to, for example, paper, textiles, foils or plastic and is fixed thereon, for example by pressure, radiation, heat or solvent action. The photoconductor used is subsequently cleaned and is available for a new recording operation.

Electrophotographic multicolor reproduction is obtainable for example through three successive recording operations with three toners of the respective primary colors magenta, yellow and cyan.

Recent developments in the production of toners concern colorants which are concerned not only with coloring but also with improving triboelectric chargeability.

A measure of the quality of a toner is its specific chargeability Q/M (charge per unit mass).

The shade of toners for monochromatic recordings is essentially determined by esthetic aspects; for a multicolor reproduction according to the principle of subtractive color mixing the decisive factors are transparency and color locus.

To set the desired shade, in some cases mixtures of pigments have been found to be suitable (Japanese Preliminary Published Applications No. 59/219,756 and 59/220,750). However, pigment mixtures have a disadvantage compared with systems with only one pigment component in that they are more cloudy and exhibit less transparency. In addition, using pigment mixtures has the disadvantage that the already complex toner recipe must be extended by at least one constituent, thereby necessitating reconsideration of pigment compatibilities, mixing problems and deviating shades. Moreover, it is not to be expected that a toner composition which has been color-adjusted by means of a pigment mixture will also have the requisite triboelectric chargeability, so that in addition a charge control agent, which in turn is in general colored itself, must be added, which again presents problems of differences in shade or leads to incompatibilities.

The fundamental suitability of 2,9-dimethylquinacridone, C.I. Pigment Red 122, for use as a magenta colorant for electrophotographic recording processes is described for example in U.S. Pat. Nos. 4,057,426, 3,804,619 and 3,909,259, according to which 2,9-dimethylquinacridone is highly suitable in respect of its shade and its transparency. However, in respect of the triboelectric chargeability of the toner 2,9-dimethylquinacridone has certain defects.

Since the three toners yellow, cyan and magenta need to be transferred in succession in the same apparatus, and the chargeabilities of the three toners thus need to be matched to one another, a three-color apparatus must meet particularly high requirements in respect of the value and the stability of the charge and the tolerable deviation from the predetermined values.

Thus it is described for example in U.S. Pat. No. 4,057,426 how by using a complicated carrier comprising steel particles coated with a polymer which in turn must contain a certain amount of copper tetra-4-(octadecylsulfonamido)-phthalo-cyanine the chargeability of the toner needs to be improved.

At the same time, it is once more pointed out in said patent specification that magenta toners (which contain 2,9-dimethylquinacridone as colorant) have hitherto only been successfully used together with a nickel berry carrier (nickel particles having a specific knot-shaped surface) (U.S. Pat. Nos. 3,909,259 and 3,804,619), since satisfactory toner transfer was only achievable by means of a particular combination of carrier and toner. Since the use of a specific nickel carrier for the magenta toner means that there is no one carrier available for the three toner colors, the recording process is made more complex by a further parameter, in particular since the use of nickel is inherently problematical on account of reservations about its toxicology.

Another approach to improving the inadequate chargeability of magenta toners consists in optimizing the resin in respect of its triboelectric properties as described in German Offenlegungsschrift No. 2,447,083. A resin optimized in this way in respect of its triboelectric properties, then, frequently exhibits problems, for example in respect of its fixing and offset behavior, its glass transition point and its dispersability. Another factor is then that in the multicolor copier the three colored toners or developers differ not only in respect of the pigments but also in respect of the toner binders. However, it is desirable that in a multicolor copier the respective components for toner and carrier or developer should be as uniform as possible and differ only in respect of the colorants used for yellow, cyan and magenta.

The present invention has shown, surprisingly, that it is possible by means of suitable mix-crystals from 2,9-dimethylquinacridone to confer on the toner a distinctly improved triboelectric chargeability without significantly altering the shade of the 2,9-dimethylquinacridone.

For instance, the chargeability of $-23.0\ \mu C./g$ (toner Example 4, with 2,9-dimethylquinacridone) improves to −40.5 μC./g (toner Example 3, mix-crystal 3 parts of 2,9-dimethylquinacridone, 1 part of unsubstituted quinacridone). Along with the improved chargeability, toners based on mix-crystals from 2,9-dimethylquinacridone and unsubstituted quinacridone exhibit an equally good charge profile as those based on 2,9-dimethylquinacridone alone.

The shade of the toner colored with the colorant (mix-crystal) according to the invention corresponds to the known suitable shade of toners containing 2,9-dimethylquinacridone. On the other hand, a mere pigment mixture of 2,9-dimethylquinacridone and quinacridone in a ratio of, for example, 3:1, incorporated in the toner, does not produce the required shade and transparency.

The magenta toners containing the colorants (mix-crystals) used according to the invention do, like the toners based on 2,9-dimethylquinacridone, have the necessary transparency.

Depending on the temperature profile in the course of mix-crystal preparation and aftertreatment, the triboelectric chargeability of mix-crystals of the same composition can be varied for example between −31.1 μC./g (toner Example (1) and −40.5 μC./g (toner Example 4).

The present invention thus provides improved magenta colorants for electrophotographic multicolor recording processes comprising mix-crystals of 95 to 60 parts of a compound of the formula I below and 5 to 40 parts of the compound of the following formula II

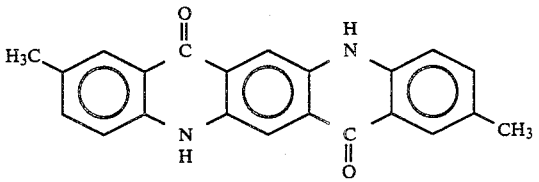

I

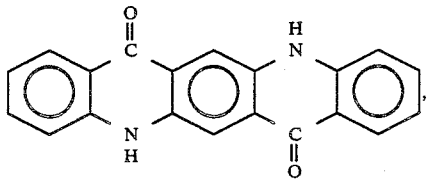

II the use thereof for preparing toners which are used for the electrophotographic copying of subject copies and for printing electronically, optically or magnetically stored data, and the use of toners or developers which have been prepared using the abovementioned magenta colorants for the reproduction of magenta in electrophotographic multicolor recording.

The preparation of the mix-crystal pigments shown is possible in a conventional manner, for example by jointly crystallizing the mix-crystal components from sulfuric acid or some other suitable solvent and subsequent solvent treatment as described in U.S. Pat. No. 3,160,510, or by salt milling the mix-crystal components and subsequent solvent treatment (German Auslegeschrift No. 1,217,333) or by cyclizing the appropriately substituted diaminoterephthalic acid mixtures and subsequent solvent treatment, as described for example in German Auslegeschrift No. 1,217,333.

Toners containing the mix-crystals from 2,9-dimethylquinacridone and unsubstituted quinacridone which are claimed according to the invention as magenta colorants possess, in addition to suitable shade and transparency, a distinctly improved triboelectric chargeability.

If there is no need with the colorants according to the invention to add a separate control agent, which would have to be added as third constituent in the preparation of the toner, the problems which can arise on addition of a control agent, such as unwanted influencing of the hue by self-color or inhomogeneous distribution of the control agent in the toner or gradual migration of the control agent out of the toner, can be completely avoided.

To incorporate the mix-crystal in the toner binder, it is generally possible to use either dried and ground pigment or for example an aqueous pigment dispersion or a pigment presscake.

The level of electrostatic charge on the toner using mixcrystals from compounds of the abovementioned formulae (I) and (II) in the stated mixing ratio and on a comparative system involving C.I. Pigment Red 122 (formula I) was measured on standard systems under identical conditions (such as identical dispersing times, identical particle size distribution, identical particle shape) at 23° C. and 50% relative humidity. The toner is activated in a two-component developer by mingling the toner with a carrier (3 parts of toner per 97 parts of carrier) on a rollbank (150 revolutions per minute) for 30 minutes.

In determining the Q/M value the particle size is very important. Extreme care was therefore taken to ensure that the toner samples obtained on sifting and listed in the following 4 Examples were uniform in respect of the particle size distribution.

The particle size distribution of the sifted toner powder was determined with a 715 Cilas Granulometer from Cilas. The average values of the particles sizes for the toners listed in the examples were between 7.4 μm and 7.9 μm.

The mix-crystal pigments A, B and C as used in the following Examples 1 to 3 are mix-crystals from 3 parts of the compound of the stated formula I and 1 part of the compound of the stated formula II, to prepare mix-crystal A (cf. Example 1) the hydrolysis being effected from polyphosphoric acid in aqueous medium at 50° C. and an aftertreatment being carried out in an alcoholic solvent at 125° C. over 5 hours;

mix-crystal B (cf. Example 2) the hydrolysis being effected from polyphosphoric acid in aqueous medium at 50° C. and an aftertreatment being carried out in an alcoholic solvent at 150° C. over 5 hours;

mix-crystal C (cf. Example 3) the hydrolysis being effected from polyphosphoric acid in aqueous medium at 70° C. and an aftertreatment being carried out in an alcoholic solvent at 120° C. over 5 hours.

The mix-crystals designated A, B and C are distinguished by three strong lines at 16.21, 8.43 and 3.28 Å, two medium lines at 8.06 and 3.51 Å and further weak lines in the X-ray diffraction spectrum. The 2,9-dimethylquinacridone listed in Comparative Example 4 (also see formula (I) above) is C.I. Pigment Red 122 (®Hostaperm Pink E).

The following Examples serve to illustrate the invention without limiting it thereto. The parts are by weight.

EXAMPLE 1

5 parts of mix-crystal pigment of type A were dispersed by means of a kneader from Werner & Pfleiderer (Stuttgart) in 95 parts of toner binder (®Dialec S 309 from Diamond Shamrock (styrene-methacrylic copolymer)) in the course of 60 minutes. This is followed by grinding on a 100 LU universal laboratory mill (Alpine, Augsburg) and classifying on a 100 MZR centrifugal sifter from Alpine.

The desired particle fraction was activated with a carrier composed of magnetite particles of size 50 to 200 μm of type 90 μm xerographic carrier form Plasma Materials Inc. coated with 90:10 styrene-methacrylate.

Measurement is carried out on a customary Q/M measuring stand [cf. J. H. Dessauer, H. E. Clark "Xerography and Related Processes", Focal Press, N.Y. 1965, page 289]; by using a sieve having a mesh width of 25 μm (508 mesh per inch) from Gebruder Kufferath, Duren, it was ensured that no carrier could be carried over in the toner blowoffs.

The Q/M value was found to be −31.1 μC./g.

EXAMPLE 2

Example 1 was repeated, except that mix-crystal pigment A was replaced by mix-crystal pigment B.

The Q/M value was found to be −36.8 μC./g.

EXAMPLE 3

Example 1 was repeated, except that mix-crystal pigment A was replaced by mix-crystal pigment C.

The Q/M value was found to be −40.5 μC/g.

EXAMPLE 4

(comparative example)

Example 1 was repeated, except that the mix-crystal pigment was replaced by the component of the stated formula I (C.I. Pigment Red 122).

The Q/M value was found to be −23.0 μC/g.

We claim:

1. An electrophotographic toner or developer containing a toner binder an a mix-crystal from 95–60 parts by weight of a compound of the formula I

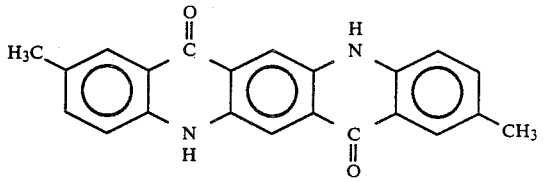

I and 5 to 40 parts by weight of a compound of the formula II as colorant (pigment).

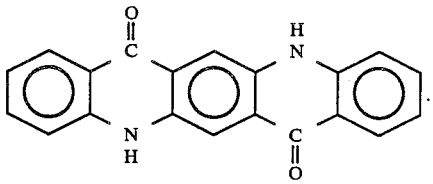

II

2. Use of the toner or developer in accordance with claim 1 for electrophotographic copying of subject copies or for printing electronically, optically or magnetically stored data.

3. Use of toner or developer in accordance with claim 1, for the reproduction of magenta in electrophotographic multicolor recording.

* * * * *

UNITED STATES PATENT AND TRADEMARK OFFICE

CERTIFICATE OF CORRECTION

PATENT NO. : 4,777,105

DATED : October 11, 1988

INVENTOR(S) : Hans-Tobias Macholdt, Alexander Sieber, and Adolf Kroh

It is certified that error appears in the above-identified patent and that said Letters Patent is hereby corrected as shown below:

In claim 1, line 2, "an" should be --and-- after "binder".

Signed and Sealed this

Twelfth Day of September, 1989

*Attest:*

DONALD J. QUIGG

*Attesting Officer*

*Commissioner of Patents and Trademarks*